United States Patent [19]

Kato et al.

[11] 3,942,142

[45] Mar. 2, 1976

[54] ELECTROMAGNETIC COORDINATE SELECTION DEVICE

[75] Inventors: Katsuhiro Kato, Yokohama; Hideo Suzuki; Norio Yano, both of Tokyo; Yojiro Kishimoto, Tokorozawa; Ginya Ishiguro, Tokyo, all of Japan

[73] Assignee: Nippon Telegraph and Telephone Public Corporation, Tokyo, Japan

[22] Filed: Nov. 27, 1974

[21] Appl. No.: 527,847

[30] Foreign Application Priority Data

| | | |
|---|---|---|
| Dec. 3, 1973 | Japan | 48-134412 |
| May 15, 1974 | Japan | 49-54078 |
| May 15, 1974 | Japan | 49-54080 |
| Oct. 21, 1974 | Japan | 49-121149 |

[52] U.S. Cl. ..... 335/112; 335/152

[51] Int. Cl.[2] ..... H01H 67/14

[58] Field of Search ..... 335/112, 151, 152, 154, 335/159

[56] References Cited

UNITED STATES PATENTS

| | | | |
|---|---|---|---|
| 3,417,353 | 12/1968 | Vigren et al. | 335/112 |
| 3,487,344 | 12/1969 | Takamura et al. | 335/112 |
| 3,523,262 | 8/1970 | Bernutz et al. | 335/112 |

*Primary Examiner*—G. Harris

*Attorney, Agent, or Firm*—Flynn & Frishauf

[57] ABSTRACT

An electromagnetic coordinate selection device comprising a plurality of electromagnetically operated cross point switches arranged in a matrix form and a plurality of magnetic cores disposed at points corresponding to said cross point switches for operation thereof, with any desired cross point switch closed only when the first and second coils wound about the magnetic cores are additively excited wherein the magnetic cores are each of the composite type to stabilize the operation of the cross point switches and the cross point switches are collectively sealed in a single container or in groups in a plurality of vessels provided in a number equal to or smaller than the number of the conductors arranged in the direction of the row or column of said matrix.

20 Claims, 30 Drawing Figures

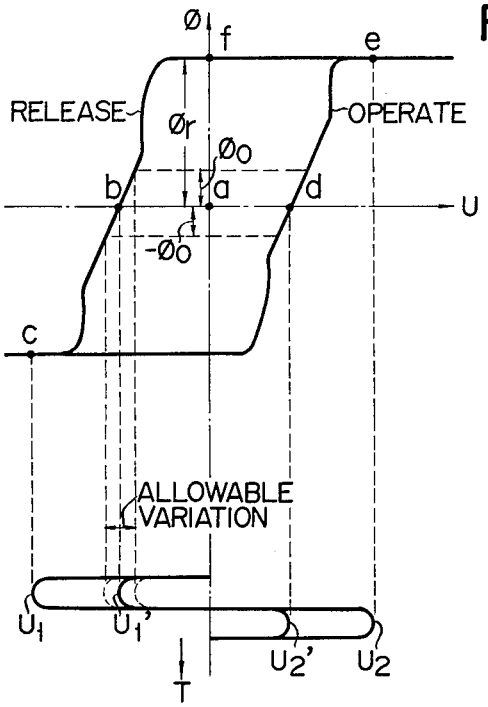
FIG. 2
PRIOR ART
FIG. 1
PRIOR ART
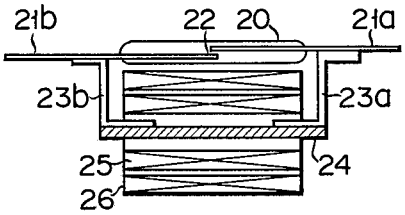
FIG. 3
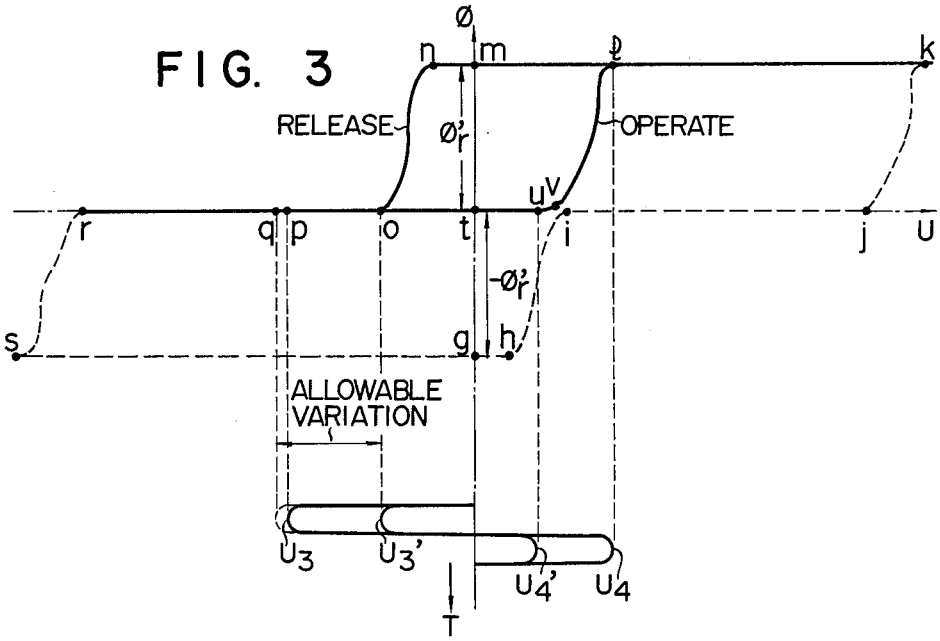

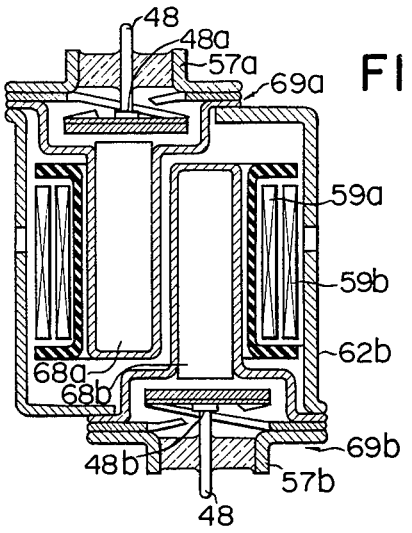
FIG. 21
FIG. 22
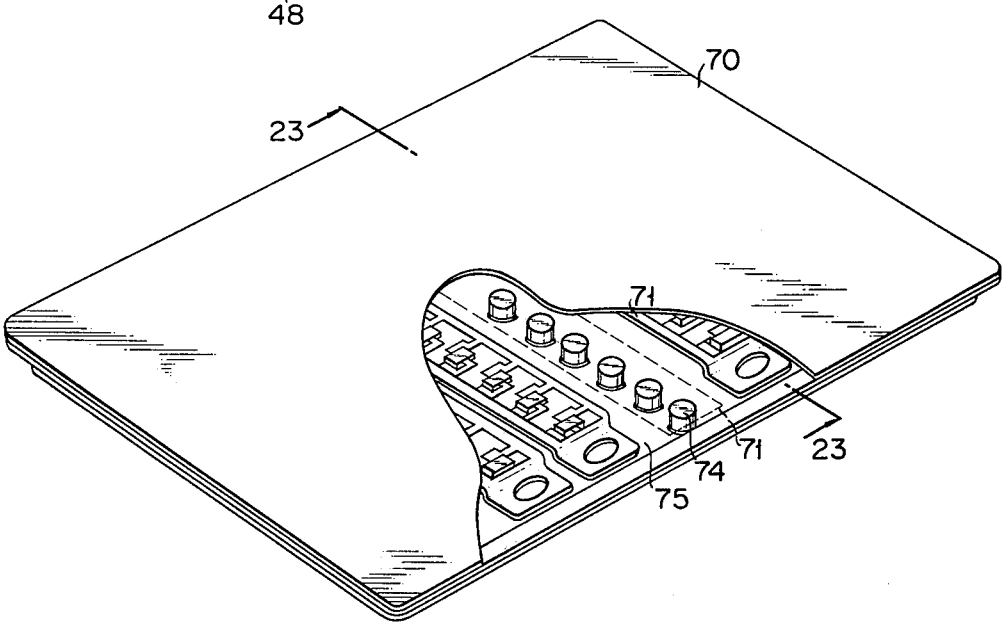
FIG. 23
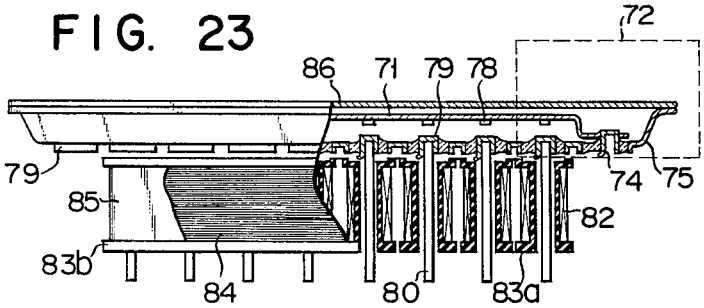

ELECTROMAGNETIC COORDINATE SELECTION DEVICE

This invention relates to an electromagnetic coordinate selection device wherein the cross points of row and column conductors are selectively closed by cross point switches arranged in a matrix form and more particularly to an electromagnetic coordinate selection device using electromagnetic cross point switches.

This electromagnetic coordinate selection device is applied to, for example, the speech path switch of a telephone exchange.

The known cross point switches used with an electromagnetic coordinate selection device to change over a speech path are of the mechanical type such as a cross bar switch and a magnetic reed switch. In this case, any cross point switch is electromagnetically operated. The electromagnetic cross point switches include the nonsealed type whose contact members are exposed to the air and the sealed type whose contact members are sealed in a container. The nonsealed cross point switch is not preferred due to the contact resistance between the contact members being affected by the atmospheric air, though capable of being manufactured at low cost. One form of reed cross point switch comprises a glass tube into which a pair of magnetic reeds are sealed, with a contact member provided at each of the mutually facing ends of said magnetic reeds; yokes connected to the magnetic reeds outside of the glass tube; a semipermanent magnetic core disposed between the yokes; and selection winding consisting of first and second coils wound about the magnetic core. According to this reed type cross point switch, a magnetic force is generated in the gap between the contact members only when prescribed pulse current passes through the first and second coils, thereby selectively closing the contact members and in consequence the speech path. Namely, where the pulse current travels through only one of the first and second coils, the contact members remain open, and where the pulse current flows through both coils, said contact members are latched in a closed state. The current transmitted through one of the two windings to open the closed contact members is hereinafter referred to as "release pulse current". With a single magnetic core, the magnetomotive force generated by the release pulse current has a peak value having a small margin. To match such small margin, therefore, line voltage, resistance in the coil windings and other wiring lines must have an extremely small margin. This fact makes it practically impossible to design an electromagnetic coordinate selection device wherein two coils are additively excited. Further where one cross point switch is sealed in one glass tube as is the case with the prior art magnetic reed switch, then difficulties will arise in rendering an electromagnetic coordinate selection device compact and inexpensive.

It is accordingly the object of this invention to provide an electromagnetic coordinate selection device capable of easily attaining design, protection of contact members from ambient atmosphere, miniaturization and cost reduction.

SUMMARY OF THE INVENTION

The electromagnetic coordinate selection device according to the present invention comprises a plurality of cross point switches each provided with a stationary contact member and a movable contact member and designed to carry out electrical connection and disconnection between the row and column conductors; a plurality of magnetic cores disposed at points corresponding to the cross point switches to drive the movable contacts thereof; first coils wound about the magnetic cores to introduce drive current of the row or column direction; and second coils wound about the magnetic cores to transmit drive current of the column or row direction, wherein the magnetic cores are each of the composite type consisting of a first magnetic core member generating a sufficient amount of coercive force to latch the movable contact member and a second magnetic core member producing a larger amount of coercive force than the first magnetic core member; and all the cross point switches are collectively sealed in a single container or in groups in a plurality of containers provided in a number equal to or smaller than the number of the row or column conductors.

The electromagnetic coordinate selection device of this invention using a composite magnetic core in place of the single magnetic core used with the prior art coordinate selection device can allow the peak value of release pulse current resorting the closed contact members to an open state to have a broad margin, facilitating the design and practical application of an electromagnetic coordinate selection device wherein the first and second coils wound about the composite magnetic core are additively excited. According to this invention, the contact members are sealed in a plurality of containers provided in a number equal at most to the number of the row or column conductors (or signal lines), thereby not only facilitating the manufacture of an electromagnetic coordinate selection device, but also rendering said device compact and inexpensive. Further, placement of a composite magnetic core outside of the contact member container (as in one embodiment of this invention) admits of its free selection. This arrangement of a magnetic core eliminates the mechanical drawback accompanying the prior art system of exposing part of the magnetic core to the interior of a metal container through glass insulator. According to another embodiment of the invention, all the magnetic cores, together with cross point switches are sealed in the same vessel, with the first and second coils wound about the magnetic cores outside of the container. According to still another embodiment, the first coils may be separately wound about the corresponding magnetic cores and a common second coil may be wound about all the magnetic cores belonging to the same row or column. It is also possible to wind a common first coil about all the magnetic cores belonging to the same row or column and wind a common second coil about all the magnetic cores belonging to the same column or row. According to a further embodiment, cross point switches belonging to two adjacent rows or columns are collectively sealed in a single container to form a speech path.

BRIEF DESCRIPTION OF THE DRAWINGS

This invention can be more fully understood from the following detailed description when taken in conjunction with the accompanying drawings, in which:

FIG. 1 shows the arrangement of a typical reed switch used with the prior art electromagnetic coordinate selection device;

FIG. 2 is a curve diagram showing the relationship of the magnetization characteristics of the prior art single magnetic core driving the reed switch of FIG. 1 and the excitating current of the magnetic core;

FIG. 3 is a curve diagram showing the relationship of the magnetization characteriztics of a composite magnetic core of this invention to drive a cross point switch and the exciting current of the composite magnetic core;

FIG. 21 is a sectional view of another modification of the column structure of FIG. 18;

FIG. 22 is an oblique view, partly in section, of the arrangement of cross point switches constituting the fourth embodiment of the invention which are sealed in a container;

FIG. 23 is a fractional sectional view on line 23—23 of FIG. 22;

DETAILED DESCRIPTION OF THE DRAWINGS

Figure 4:
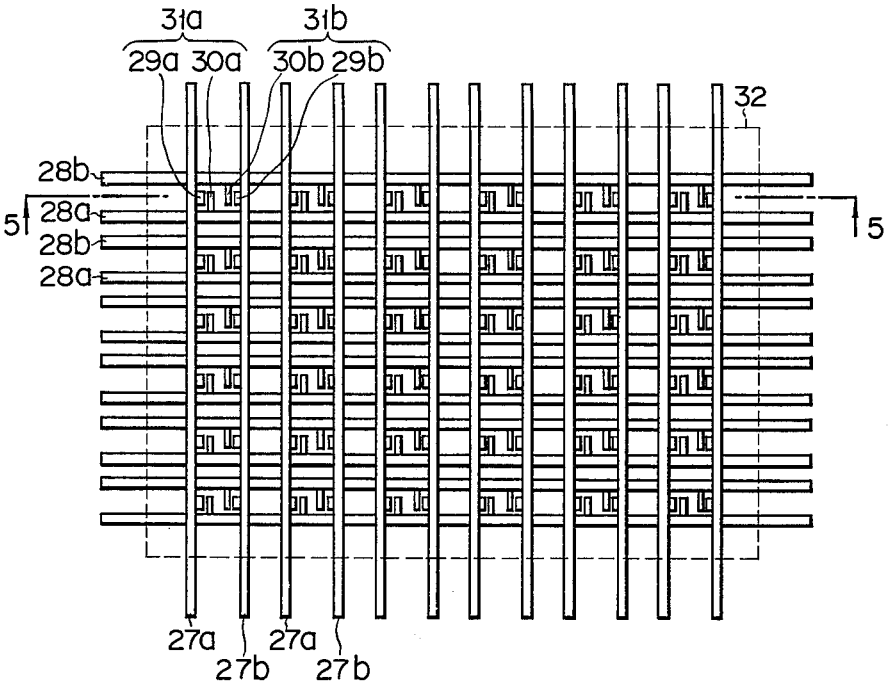
FIG. 4 indicates the arrangement of cross point switches relative to the row and column conductors used in one embodiment of this invention.

Prior to the detailed description of the first embodiment of this invention, there will now be discussed for better understanding of the invention the structure of one form of the prior art magnetic reed switch and the magnetization characteristics of the magnetic core by reference to FIGS. 1 and 2. In FIG. 1, the magnetic reed switch comprises a glass tube 20 and magnetic reeds 21*a*; 21*b* sealed therein. Those end portions of the magnetic reeds 21*a*, 21*b* which are sealed in the glass tube 20 constitute contact members. Where the magnetic reed switch is open, a gap 22 is formed between the contact members. The magnetic reeds 21*a*, 21*b* are connected to yokes 23*a*, 23*b* respectively. A common semipermanent magnetic core 24 is connected to the free ends of the yokes 23*a*, 23*b*. Where the magnetic reed switch is used with an electromagnetic coordinate selection device, pulse current running in the row direction passes through a first coil 25 and pulse current traveling in the column direction flows through a second coil 26. FIG. 2 shows the magnetization characteristics of the magnetic core 24 for driving the magnetic reed switch. Namely, the magnetomotive force U generated in the magnetic core 24 is shown on the abscissa, and the magnetic flux $\phi$ passing through the gap 22 of the magnetic reed switches 21*a*, 21*b* is shown on the ordinate. Pulses of the current transmitted through the first coil 25 are indicated in the form of magnetomotive forces $U_1'$, $U_2'$ (T denotes the time sequence in which said pulses of current are applied). This description also applies to the pulses of current introduced through the second coil 26. Pulse $U_1'$ is designated as negative release pulse, and pulse $U_2'$ as positive operation pulse. Now let it be assumed that the first and second coils 25, 26 are supplied alike with the negative release pulse $U_1'$ and positive operation pulse $U_2'$ in succession. Then the magnetic core 24 gives forth a negative magnetomotive force having a peak value $U_1$ and a positive magnetomotive force having a peak value $U_2$. These magnetomotive forces cause the magnetic core 24 to be magnetized through a route of $a \rightarrow b \rightarrow c \rightarrow d \rightarrow e \rightarrow f$ or a route of $f \rightarrow b \rightarrow c \rightarrow d \rightarrow e \rightarrow f$. The contact members of the magnetic reed switch are closed by a magnetic force generated in the gap 22 between the magnetic reeds 21*a*, 21*b* by a residual magnetic flux $\phi_r$ at point *f*. The contact members of the magnetic reeds 21*a*, 21*b* are latched in the closed state. Namely, the contact members are prevented from being opened from said latched condition of *f*. Where only one of the first coil (in the row direction) and the second coil (in the column direction) is impressed with a negative release pulse $U_1'$ and a positive operation pulse $U_2'$ in succession, then the magnetic core 24 is magnetized through a route of $f \rightarrow b \rightarrow a \rightarrow d \rightarrow a$ or $a \rightarrow b \rightarrow a \rightarrow d \rightarrow a$, with the residual magnetic flux $\phi_r$ reduced to a value approximating zero, thereby causing the contact members of the magnetic reed switch to be opened by the righting moment of the magnetic reed switches acting as springs. Where the first and second coils are simultaneously supplied with pulse current, the magnetic reed switch is closed electrically to connect the row and column conductors, thereby selecting a desired signal channel. In this case, it may be deemed advisable to set the residual magnetic flux at a smaller value than an absolute level $\phi_0$ to open the contact members. Since, however, a release pulse used to this end has a peak value having a very narrow margin, the line voltage, coil resistance and wiring resistance have a restricted margin, presenting difficulties in designing an electromagnetic coordinate selection device.

There will now be described by reference to FIG. 3 the magnetization characteristics of a composite magnetic core according to this invention which consists of a first semipermanent magnetic core having a sufficient coercive force to latch the closed switch contact members and a second semipermanent magnetic core having a fully larger coercive force than that of the first semipermanent magnetic core and being saturable at a magnetic flux nearly equal to the flux of the first semipermanent mmagnetic core. Now let it be assumed that the composite magnetic core is magnetized at point *g* denoting a negative residual magnetic flux $-\phi_r'$. Where at least one of the first and second coils is impressed with positive current, then the magnetization condition of a magnetic core having a smaller coercive force is reversed at point *h* and shifted to point *i*. Where a larger amount of the positive current is applied, then the magnetization condition of said second magnetic core having said larger coercive force is reversed at point *j* and transferred to point *k*. Where a smaller amount of the positive current is transmitted through said coils, then the magnetization condition of the composite magnetic core passes point *l* to point *m* indicating a positive residual magnetic flux $\phi_r'$.

Where at least one of the first and second coils is supplied with negative current, then the composite magnetic core is magnetized through a route of $m \rightarrow n \rightarrow o \rightarrow p \rightarrow q \rightarrow r \rightarrow s$. Where the magnetization condition of the composite magnetic core lies at any point on a line extending between point *o* at which said magnetization condition is reversed and point *r*, and under this condition the negative current is shut off, then the magnetization condition of the composite magnetic core is moved to point *t* at which the residual magnetic flux is substantially reduced to zero. Where at least one of the first and second coils is supplied with negative current, then the composite magnetic core is magnetized through a route of $v \rightarrow o \rightarrow p \rightarrow q \rightarrow r \rightarrow s$. Where positive current is impressed at point *t*, then the composite magnetic core is magnetized through a route of $t \rightarrow u \rightarrow v \rightarrow l \rightarrow k$.

Where the first and second coils are both supplied with negative release pulse current and positive operation pulse current in succession, then the negative magnetomotive force of the composite magnetic core will have a peak value $U_3$ ($=2U_3'$) and the positive magnetomotive force thereof will have a peak value $U_4$ ($=2U_4'$). Thus the composite magnetic core is magnetized through a route of $m \rightarrow n \rightarrow o \rightarrow p \rightarrow o \rightarrow t \rightarrow u \rightarrow v \rightarrow l \rightarrow m$ or $t \rightarrow o \rightarrow p \rightarrow o \rightarrow t \rightarrow u \rightarrow v \rightarrow l \rightarrow m$. As the result, the cross point switch is closed and latched in that state by a magnetic force resulting from a residual magnetic flux $\phi_r'$ at point *m*. Where only one of the first and second coils is impressed with negative release pulse current and positive operation pulse current according to the time sequence T, then the negative magnetomotive force of the composite magnetic core has a peak value $U_3'$ and the positive magnetomotive force thereof has a peak value $U_4'$. It will be noted that $U_3'$ has a value equal to half that of $U_3$ and $U_4'$ has a value equal to half that of $U_4$. Where the contact members of the cross point switch are closed, namely, the residual magnetic flux lies at point *m*, then the composite magnetic core is magnetized through a route of $m \rightarrow n \rightarrow o \rightarrow t \rightarrow u \rightarrow t$. And where the contact members of the cross point switch are opened, namely, the residual magnetic flux stands at point *t*, then the composite magnetic core is magnetized through a route of $t \rightarrow o \rightarrow t \rightarrow u \rightarrow t$, with the residual magnetic flux substantially reduced to zero. Thus the contact members of the cross point switch are opened by the righting moment of the magnetic reeds acting as springs. In this case, the magnetomotive force should have a smaller peak value $U_3$ than that at point *r*. This means that the peak value $U_3'$ of a negative magnetomotive force is allowed to vary within the range lying between point *o* and point *q* at which a magnetomotive force is produced with a value equal to half that at point *r*. Namely, according to this invention, the peak value of the negative magnetomotive force can have a broader margin than in the case where a single form of magnetic core 24 is used. The larger the difference between the coercive forces of two magnetic core members constituting the composite magnetic core, the broader the range within which the peak value of the magnetomotive force is allowed to vary.

As mentioned above, according to this invention, an electromagnetic coordinate selection device can be very easily designed owing to the use of a composite magnetic core for driving contact members of a cross point switch. In this case, the cross point switches should be sealed in container means for protecting the contact members from being affected by air atmosphere. However, the number of said containers, the condition in which the contact members of each cross point switch are electrically connected, the arrangement of a plurality of composite magnetic cores and the arrangement of the first and second coils are decisive factors in designing and manufacturing an electromagnetic coordinate selection device as well as in rendering said device compact and inexpensive.

Figure 5:
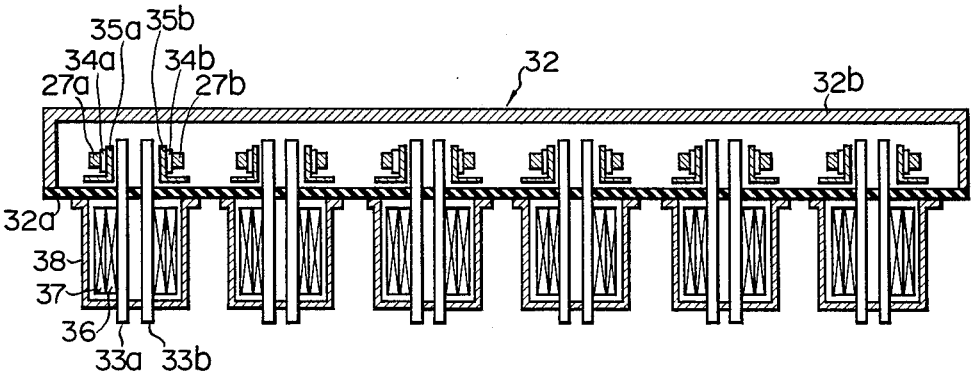
FIG. 5 is a sectional view on line 5—5 of FIG. 4.

There will now be described by reference to FIGS. 4 to 9 the first embodiment of this invention which can be practised in various forms. FIG. 4 presents an embodiment having twelve row conductors and twelve column conductors. As detailed later, column conductors 27*a*, 27*b* and row conductors 28*a*, 28*b* are provided in pairs with respect to each pair of cross point switches included in the respective sections of the column and row structures. A column conductor 27*a* is provided with a movable contact member 29*a* and a row conductor 28*a* with a stationary contact member 30*a*. These movable and stationary contact members 29*a*, 30*a* constitute a cross point switch 31*a*. Similarly, a column conductor 27*b* is provided with a movable contact member 29*b* and a row conductor 28*b* with a stationary contact member 30*b*. These movable and stationary contact members 29*b*, 30*b* form another cross point switch. A plurality of said cross point switches 31*a*, 31*b* are all sealed in a single container 32. Composite magnetic cores corresponding to cross point switches and exciting coils thereof are not shown in FIG. 4. The arrangement of the cross point switches, composite magnetic cores and exciting coils is set forth in FIG. 5 showing a sectional view on line 5—5 of FIG. 4. Referring to FIG. 5, an insulation substrate 32*a* and a cover plate 32*b* jointly constitute the above-mentioned single container 32. The composite magnetic cores 33*a*, 33*b* penetrate the insulation substrate 32*a* in an airtight state. The indicated upper portion of each composite megnetic core is sealed in the container 32, and the indicated lower portion thereof is disposed outside of said container 32. The composite magnetic core, for example 33*a*, consists of a first semipermanent magnetic core member having a sufficient coercive force to latch the movable contact member 29*a* or an armature 35*a* and a second magnetic core member having a larger coercive force than the first magnetic core member. It will be noted that according to the first embodiment of this invention, the first and second magnetic core members are shown to have an equal cross sectional area and assembled in an integral body in an indistinguishable form. The armature 35*a* is disposed through a movable spring member 34*a* on the indicated right side of the column conductor 27*a*. The magnetic core member 33*b*, column conductor 27*b*, movable spring 34*b* and armature 35*b* have the same arrangement as those bearing the same numerals suffixed by the letter *a*. Unless particularly required, therefore, description is only given of the elements designated by numerals suffixed by the letter "*a*". A first common exciting coil 36 is only wound about every two composite magnetic cores, while a second common exciting coil 37 is wound about all twelve composite magnetic cores arranged in a direction extending at right angles to the drawing, namely, six composite magnetic cores indicated by 33*a* and six composite magnetic cores shown by 33*b*. Referential numeral 38 denotes a yoke which is penetrated by the composite magnetic cores 33*a*, 33*b* with a necessary space allowed between said magnetic cores and yoke to prevent electrical conduction.

Figure 6A:
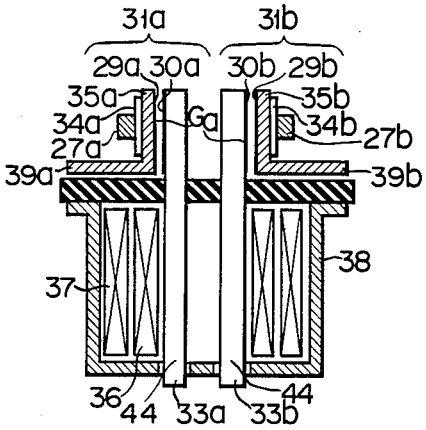
FIG. 6A is a magnified sectional view of a unit driving device of a pair of adjacent cross point switches of FIG. 5.
Figure 6B:
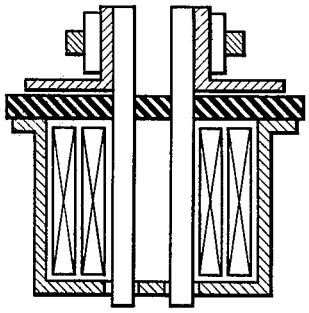
FIG. 6B is a magnified sectional view of the unit driving device of FIG. 6A where the paired cross point switches are closed.

A unit structure for operating the aforesaid two cross point switches 31*a*, 31*b* (FIG. 4) is shown in magnification in FIGS. 6A and 6B. Referring to FIG. 6A, a stationary contact member 30*a* is provided by plating or welding a proper contact metal on the indicated upper left side of the composite magnetic core 33*a*, and a movable contact member 29*a* is provided by plating or welding a proper contact metal on the indicated right side of the armature 35*a*. One bent end of the armature 35*a* constitutes a yoke portion 39*a* for passage of a magnetic flux. Where the cross point switch 31*a* is not closed, a gap G*a* is formed, as shown in FIG. 6A, between the movable contact member 29*a* and stationary contact member 30*a*. Since the structure of the right half section of FIG. 6A is exactly the same as that of the left half section, description of the right half section is omitted with the component parts thereof simply designated by referential numerals bearing a suffix "*b*" to be distinguished from those of the left half section. FIG. 6B shows the closed condition of the cross point switches 31*a*, 31*b* of FIG. 6A.

Figure 7A:
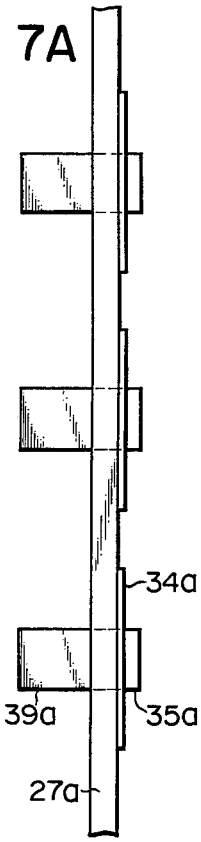
FIG. 7A is a top view showing the positional relationship of one column conductor, contact member and movable spring associated with the cross point switch of FIG. 5.
Figure 7B:
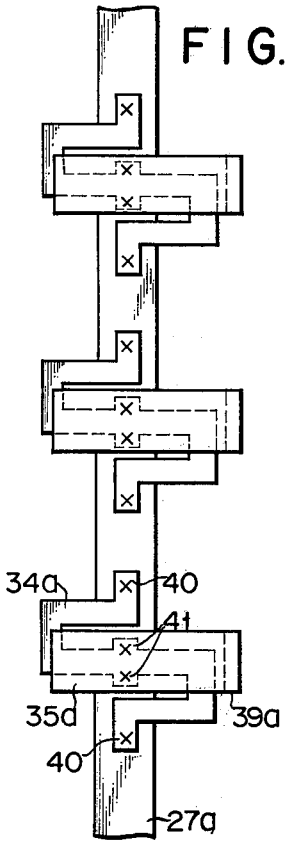
FIG. 7B is a side view of FIG. 7A.

The arrangement of the armature 35*a* and movable spring member 34*a* relative to the column conductor 27*a* is set forth in FIG. 7A, and a plan view of the arrangement of the movable spring member 34*a* and armature 39*a* is shown in FIG. 7B. According to the first embodiment, each flexible metal strip bearing the shape of a letter S is welded, as seen from FIG. 7B, to the column conductor 27*a* at point 40. The armature 35*a* is welded to the central or movable part of the flexible metal strip at point 41, to be easily displaced within a prescribed distance (in a direction perpendicular to the drawing). The movable spring member 34*a* may be formed into a vibratory disk or spiral shape.

Outside of the container 32 of FIG. 5, six composite magnetic cores 33*a* belonging to the same row are jointly connected to the row conductor 28*a*, and six composite magnetic cores 33*b* are jointly connected to another row conductor 28*b*. The electrical connections of all composite magnetic cores are shown in the oblique view of FIG. 8A.

Figure 8A:
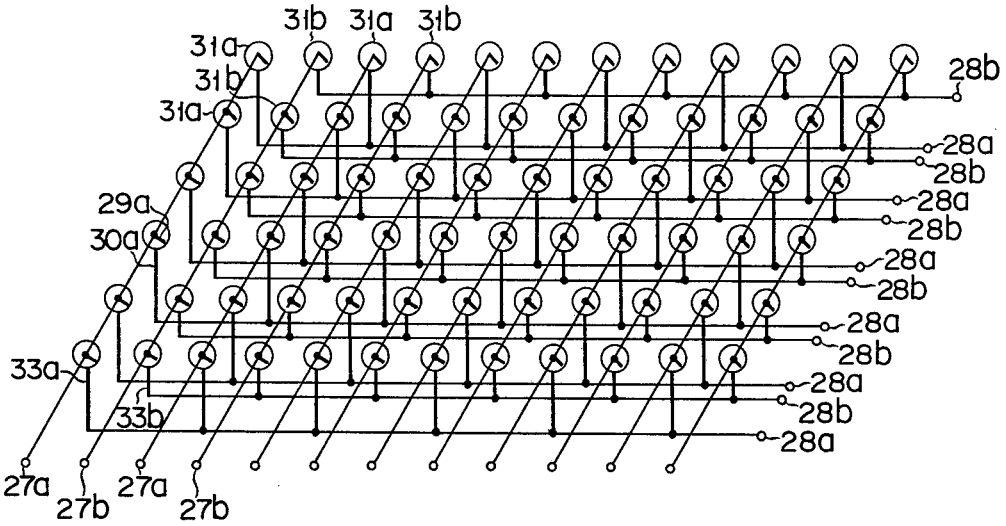
FIG. 8A is an oblique view of FIG. 4, showing the manner in which the magnetic cores are connected to each other.
Figure 8B:
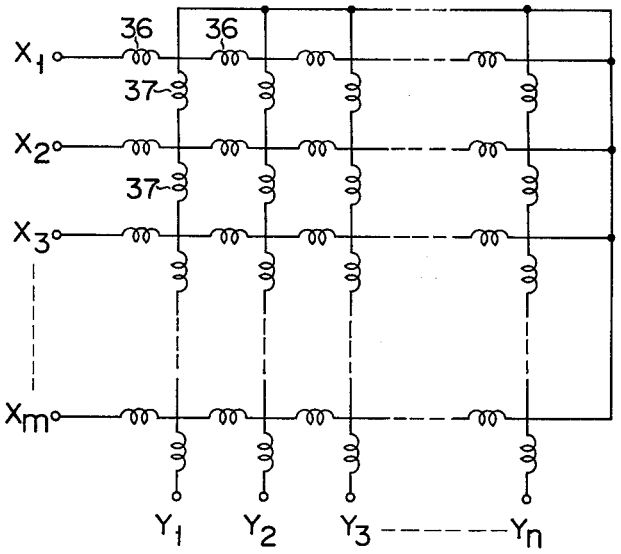
FIG. 8B presents the matrix arrangement of coils wound about the magnetic cores of FIG. 8A.

As shown in FIG. 8B, the first exciting coils (or referred to as "row coils") 36 are connected in series for each row. These series circuits are connected at one end to row input terminals $X_l$ to $X_m$ respectively, and jointly connected at the other end. The second exciting coils (or referred to as "column coils") 37 are connected in series for each column. These series circuits are connected at one end to column input terminals $Y_l$ to $Y_n$, and jointly connected at the other end. The common cross points of the respective groups of series connected row coils 36 are electrically connected to the corresponding common cross points of the respective groups of series connected column coils 37. It is noted that though a single column coil is wound, as previously described, about two column magnetic cores in common, said coil is indicated in a divided form in FIG. 8B.

The container 32 consists of an insulation member which may be formed of ceramics, glass, plastics or metal. Where the container 32 is made of metal, those portions of said container 32 which are penetrated by the composite magnetic cores and the column conductors 27*a*, 27*b* should be protected for insulation by, for example, glass.

There will now be described the operation of the first embodiment of this invention constructed as previously mentioned. Where the movable contact member 29*a* and stationary contact member 30*a* are closed by a residual magnetic flux at point A on a line representing the magnetization characteristics of FIG. 9 and, under this condition, one of the first and second coils 36, 37 is impressed with pulses $P_1$, $P_2$ (denoted by ampere turn) in a time sequence T, then the composite magnetic core is magnetized through a route of A → B → O → G → O'. Where the contact members 29*a*, 30*a* are opened, namely, the composite magnetic core is magnetized at point O', then the magnetization point is shifted through a route of O' → B → O → G → O'. In either case, the contact members 29*a*, 30*a* are opened to be latched in this state. Where the first and second coil windings are supplied alike with pulses $P_1$, $P_2$ in succession, then the composite magnetic core is additively excited and brought to a state equivalent to that in which pulses $P_1'$, $P_2'$ are impressed on one of the coil windings. In this case, the composite magnetic core is magnetized through a route of A → B → C → B → O → G → F → A when the contact members 29*a*, 30*a* are closed, and through a route of O' → B → C → B → O → G → F → A when the contact members 29*a*, 30*a* are opened. In either case, the contact members 29*a*, 30*a* are latched in a closed state. The character $\phi$ denotes a magnetic flux passing through the gaps G*a*, G*b* (FIG. 6A). Where a residual magnetic flux lies at point A, then the armatures 35*a*, 35*b* are attracted to the composite magnetic cores 33*a*, 33*b* respectively against the righting moment of the corresponding spring members 34*a*, 34 *b*. Where a residual magnetic flux decreases from that which appeared at point O′, then the armatures 35*a*, 35*b* are displaced by the righting moment of the corresponding spring members 34*a*, 34*b* to render the cross point switches 31*a*, 31*b* nonconducting. The passageway of the magnetic flux $\phi$ in the composite magnetic core is indicated by referential numeral 44 in FIG. 6A. With the first embodiment of this invention using a composite magnetic core, the contact members 29*a*, 30*a* can be operated, as previously described by reference to FIG. 3, under a stable condition, even when the negative magnetomotive force of the release pulse of FIG. 9 has a peak value varying from point $P_1$ to point Q.

Figure 9:
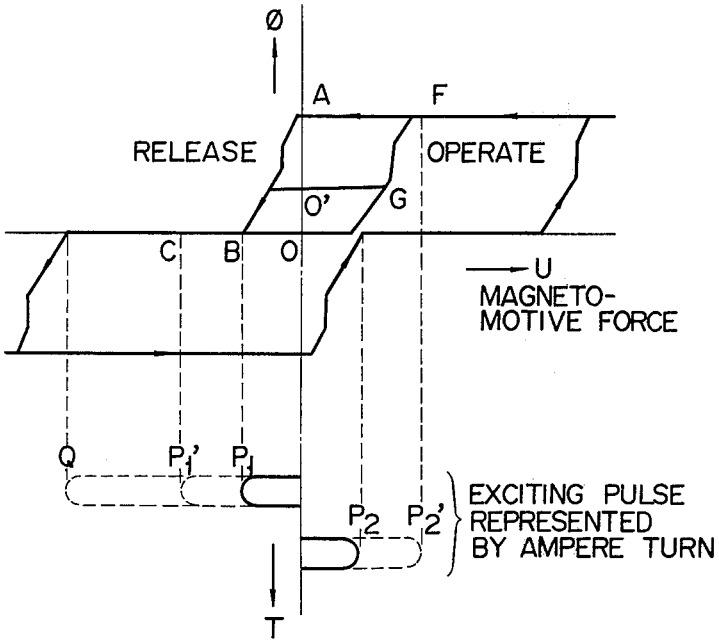
FIG. 9 is a curve diagram showing the magnetization characteristics of the composite magnetic core of FIG. 6A.

There will now be described the manner in which any cross point of the coordinate is selected. Where it is desired to pick up, for example, a cross point $(x_j.y_k)$ in FIG. 8B, positive and negative pulses of FIG. 9 are impressed in succession between the terminals $x_j$ and $y_k$. Then a coil at the cross point $(x_j.y_k)$ is brought to a state equivalent to that in which current generating ampere turns $P_1'$, $P_2'$ flows through said coil. Accordingly, the switch at the cross point $(x_j.y_k)$ is latched in a closed state. The coils at other cross points than that of $(x_j.y_k)$ which are only supplied with current generating ampere turns $P_1$, $P_2$ are latched in an open state.

Figure 10:
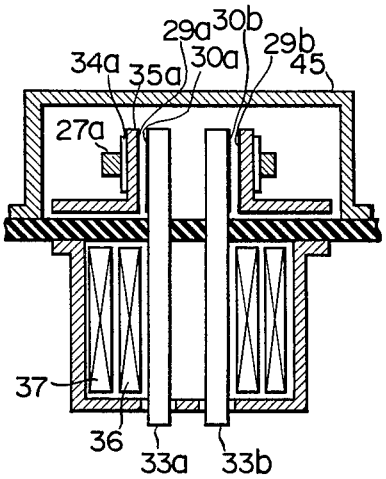
FIG. 10 shows a modification of the first embodiment of FIGS. 4 to 9.

According to the above-mentioned first embodimemt, all the cross point switches were sealed in a single container 32. However, it is possible to seal cross point switches included in every two adjacent columns in separate containers 45 as in the embodiment of FIG. 10.

There will now be described by reference to FIGS. 11 to 15 the second embodiment of this invention. This embodiment is characterized in that all the composite magnetic cores are provided fully outside of the corresponding sections of a container and are not concurrently used as electric conductors, and that the cross point switches belonging to the same column are sealed in a single metal container.

Figure 11:
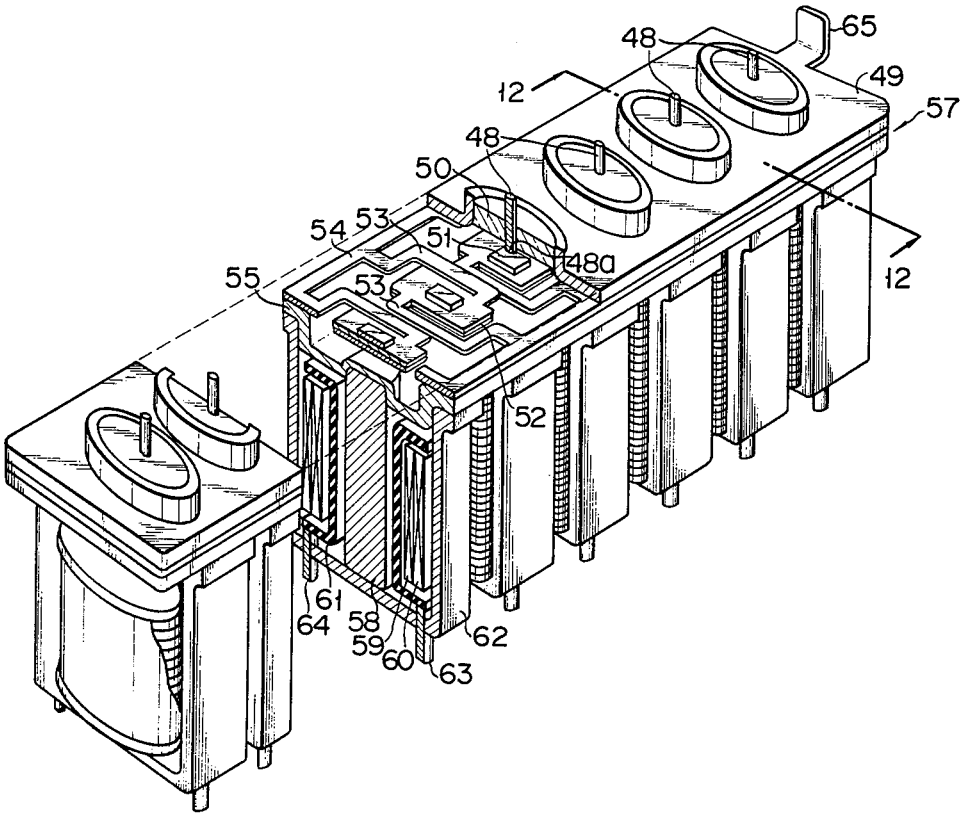
FIG. 11 is an oblique view of one of the column structures included in the second embodiment of this invention.
Figure 12:
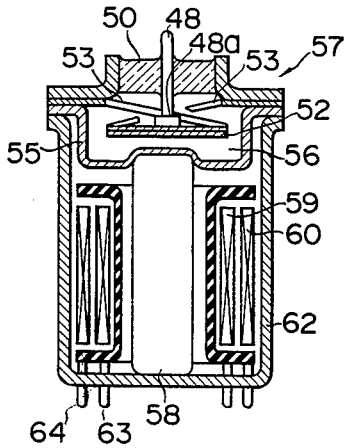
FIG. 12 is a sectional view on line 12—12 of FIG. 11.
Figure 13:
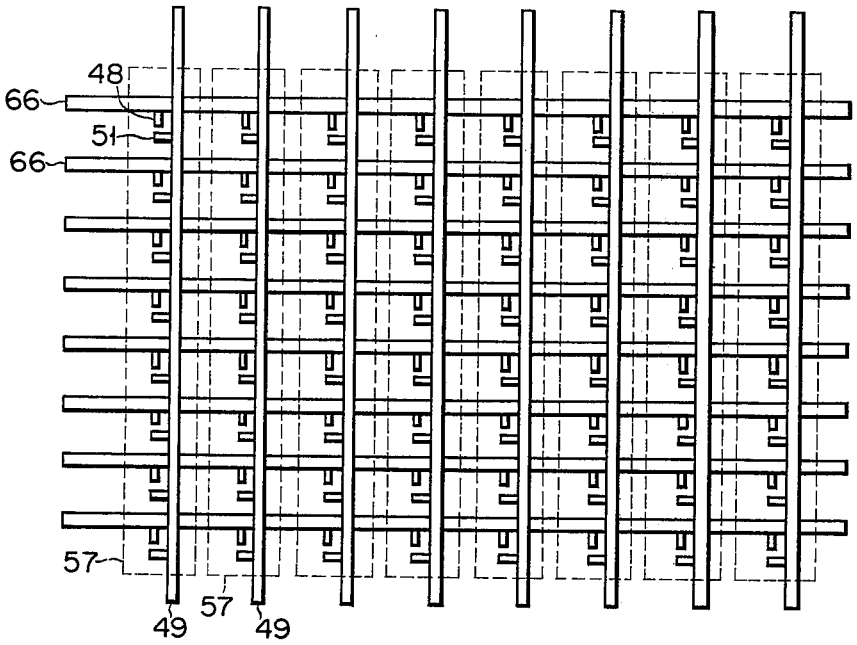
FIG. 13 is a plan view showing the arrangement of row and column conductors, cross point switches and containers included in the electromagnetic coordinate selection device of this invention formed of a plurality of the column structures of FIG. 11.
Figure 14:
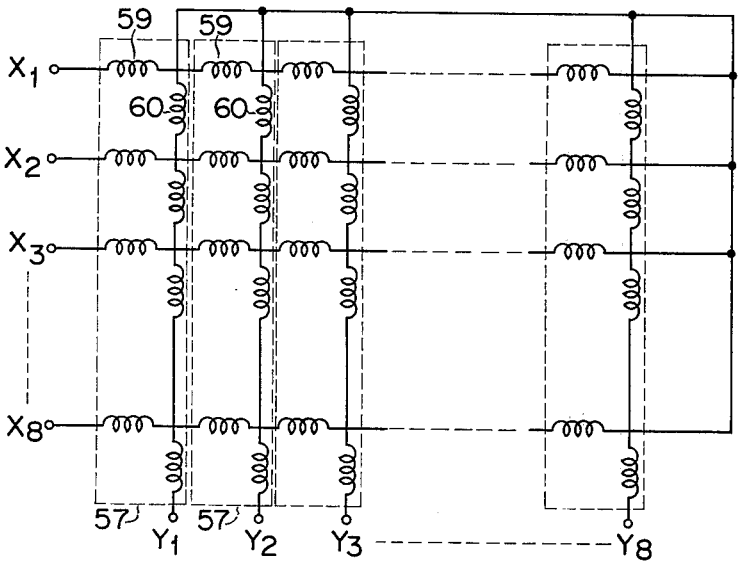
FIG. 14 sets forth the matrix arrangement of the first and second coils wound about the magnetic cores corresponding to that of FIG. 13.

FIG. 11 is an oblique view of the arrangement of cross point switches belonging to the same column and the corresponding drive units. FIG. 12 shows a cross point switch included in the embodiment of FIG. 11 and the corresponding drive unit. Throughout FIGS. 11 and 12, referential numeral 48 denotes a stationary or signal terminal, the lower end of which is provided with a stationary contact member 48*a*. The signal terminal 48 projects above a column conductor 49 through a glass insulator 50. A movable contact member 51 (FIG. 11) is provided on an armature 52 so as to face the stationary contact member 48*a*. The armature 52 is flexibly supported by a spring member 53. This spring member 53 is punched, for example, out of an elastic plate 54 (FIG. 11) being fitted lengthwise of a column structure. Said elastic plate 54 is interposed between a metal plate 55 having its crosswise central portion depressed and the column conductor 49, thereby defining a container 57 provided with a cross point switch-sealing chamber 56. A composite magnetic core 58 is set in place by pressing that end face of the composite magnetic core which electromagnetically drives the armature 52 against the outer surface of the metal plate 55. The composite magnetic core 58 is wound with first and second coils 59, 60. Referential numeral 61 is a bobbin on which to wind said first and second coils about the composite magnetic core 58. A yoke 62 is supported by the metal plate 55. Referential numerals 63, 64 denote the terminals of the first and second coils 59, 60 respectively. Referential numeral 65 is the outer connector of a column conductor. As shown in FIG. 13, the signal terminals 48 of the respective rows are connected to the corresponding row conductors 66 fully outside of the container 57. A plan view of the arrangement of the row conductors 66, column conductors 49, containers 57, signal terminals 48 (including the stationary contact member 48*a*) and movable contact members 51 is set forth in FIG. 13. The matrix arrangement of the first and second coils 59, 60 is shown in FIG. 14. Namely, the first coils 59 belonging to the respective rows are connected in series. These series circuits are connected at one end to the corresponding terminals $X_1$ to $X_8$ and jointly connected at the other end. The second coils 60 belonging to the respective columns are connected in series. These series circuits are connected at one end to the corresponding terminals $Y_1$ to $Y_8$ and jointly connected at the other end.

The above-mentioned common junctions are electrically connected. The second coil may be wound about all the composite magnetic cores belonging to the same column. In this case, the second coil or column coil 60 shown in FIG. 14 should be considered a coil arranged equivalently corresponding to a switch.

Figure 15:
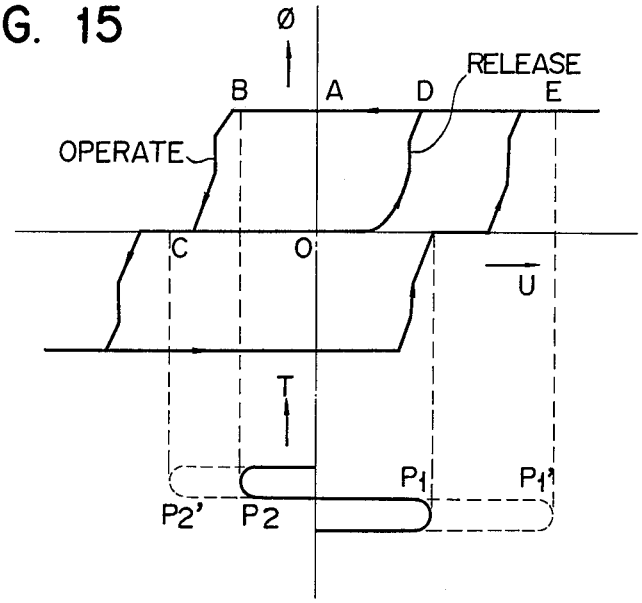
FIG. 15 indicates the magnetization characteristics of a composite magnetic core used in the second embodiment of the invention.

There will now be described the operation of the second embodiment of this invention. Where, in FIG. 15, a residual magnetic flux $\phi$ appears at point A on a curve showing the magnetization characteristics of the composite magnetic core 58, then the armature 52 is electromagnetically attracted to said composite magnetic core 58, causing the stationary contact members 48*a* provided on the signal terminal 48 and movable contact member 51 to be separated, namely, the cross point switch to be latched in an open state. Where a residual magnetic flux $\phi_r$ lies at point O (in FIG. 15 the residual magnetic flux is shown to be zero), then the armature 52 is released by the spring member 53 to cause the movable contact member to contact the stationary contact member 48*a*, namely, to latch the cross point switch in a closed state. Where, under this condition, one of the first and second coils 59, 60 is impressed with pulses $P_2$, $P_1$ (represented by ampere turns) successively in a time sequence T, then the composite magnetic core 58 is magnetized through a route of O → D → A → B → A when said magnetic core was previously magnetized at point O, namely, when the cross point switch was closed. Where the composite magnetic core 58 was previously magnetized at point A, namely, the cross point switch was opened, then the composite magnetic core 58 is magnetized through a route of A → D → A → B → A. Therefore, whether the cross point switch was previously closed or opened, said switch is latched in an open state, because the armature 52 is electromagnetically attracted to the composite magnetic core 58 due to a residual magnetic flux at point A. Where the first and second coils 59, 60 are impressed alike with pulses $P_2$, $P_1$ in succession, then the composite magnetic core 58 is magnetized by pulse $P_2'$ (having a peak value twice that of pulse $P_2$) and pulse $P_1'$ (having a peak value twice that of pulse $P_1$). Where, in this case, the composite magnetic core was previously magnetized at point O, namely, the cross point switch was closed, then the composite magnetic core 58 is magnetized through a route of O → D → E → D → A → B → C → O. Where the composite magnetic core 58 was previously magnetized at point A, namely, the cross point switch was opened, then said composite magnetic core 58 is magnetized through a route of A → D → E → D → A → B → C → O. Accordingly, the cross point switch is latched in a closed state, regardless of whether said switch was previously opened or closed.

Where in FIG. 14, it is desired to select the cross point of the third row and second column, then the pulses $P_2$, $P_1$ of FIG. 15 are impressed between the terminal $X_3$ and $Y_2$. Then the composite magnetic core 58 at this cross point ($X_3.Y_2$) is brought to a state equivalent to that in which said magnetic core 58 is excited by pulses $P_2'$, $P_1'$. Accordingly, the cross point switch is latched in a closed state. On the other hand, composite magnetic cores 58 at other points than the above-mentioned cross point ($X_3$, $Y_2$) are only excited by pulses $P_1$, $P_2$, causing the switches at said other cross points to be latched in an open state.

There will now be described the arrangement of FIG. 16 where each pair of cross point switches included in two adjacent columns are assembled in an integral body. This arrangement is a first modification of the second embodiment capable of simplifying the construction of the electromagnetic coordinate selection device of this invention. According to this modification, the container 57*a* of the first column and the container 57*b* of the adjacent second column are disposed in opposite directions and assembled in an integral body by a yoke 62*a*. A composite magnetic core 58*a* corresponding to the indicated upper cross point switch and a composite magnetic core 58*b* corresponding to the indicated lower cross point switch are linearly arranged with the switch-nondriving end faces of said magnetic cores positioned opposite to each other. The first and second coils 59*a*, 60*a* are wound about both composite magnetic cores 58*a*, 58*b* in common through a bobbin 61*a*. In this case, it is possible to wind the second coil 60*a* about all the composite magnetic cores belonging to the first and second columns. The parts of each cross point switch will be easily understood by reference to FIG. 12, description thereof being omitted.

Figure 16:
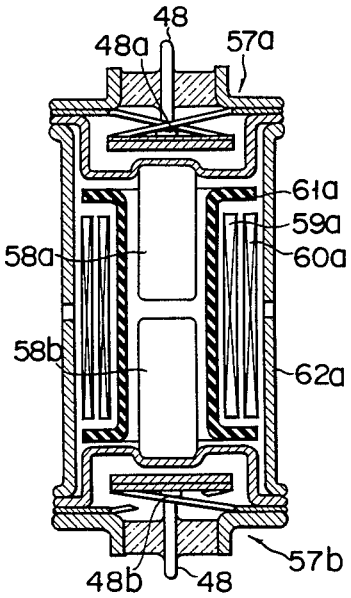
FIG. 16 is a sectional view of a modification of the structure of FIG. 12.
Figure 17:
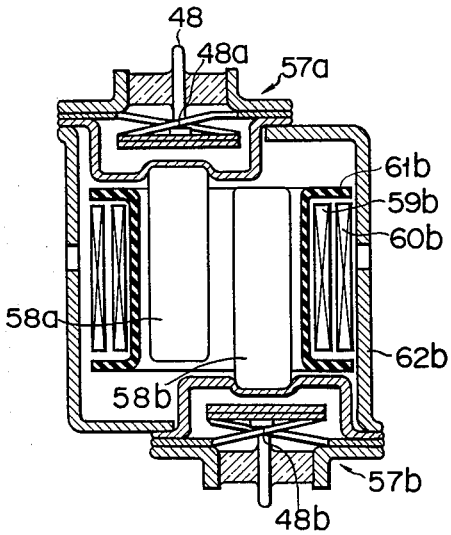
FIG. 17 is a sectional view of another modification of the structure of FIG. 12.

FIG. 17 is a sectional view of each pair of the integrally assembled cross point switches belonging to two adjacent columns as in FIG. 16. This arrangement is a second modification of the second embodiment of this invention. According to this second modification, the container 57*a* of the first column and the container 57*b* of the adjacent second column are integrally assembled in opposite directions by a yoke 62*b* with the vertical central lines of said containers 57*a*, 57*b* disposed crosswise apart instead of being aligned as in FIG. 16. In this case, the composite magnetic cores 58*a*, 58*b* are so disposed as to have the side walls set face to face. The first and second coils 59*b*, 60*b* are wound about the composite magnetic cores 58*a*, 58*b* in common by means of a bobbin 61*b*. The second coil 60*b* may be wound about all the composite magnetic cores of the first and second columns in common.

The second embodiment, wherein the composite magnetic cores are provided fully outside of the container 57 has the advantages that the composite magnetic cores need not be heated as is the case with the prior art coordinate selection device wherein the magnetic core is partly received in a container through a glass insulator; the glass insulator is little likely to be broken by an external force; and an electromagnetic coordinate selection device can be made compact and inexpensive.

Figure 18:
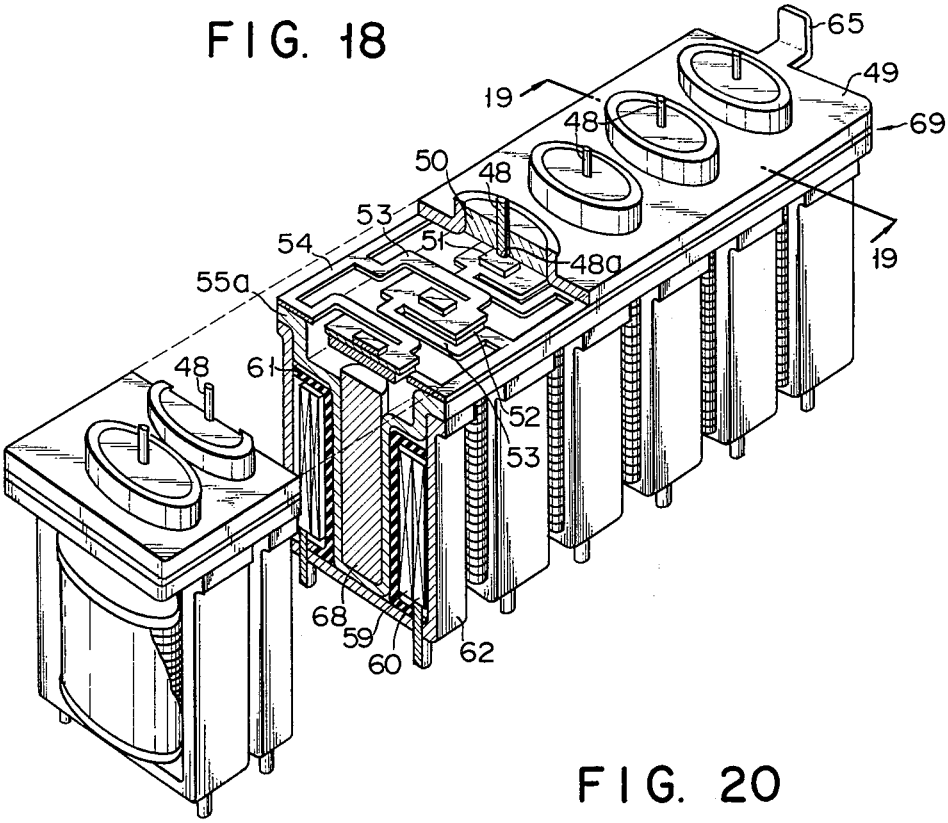
FIG. 18 is an oblique view of one of the column structures included in the third embodiment of the invention.
Figure 19:
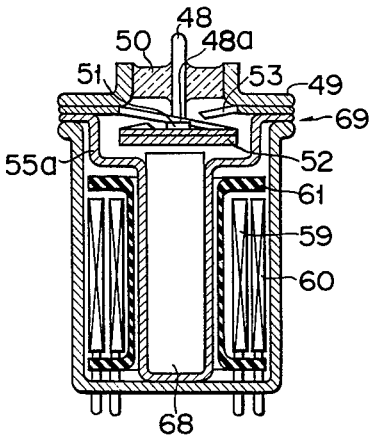
FIG. 19 is a sectional view on line 19—19 of FIG. 18.

There will now be described by reference to FIGS. 18 and 19 a third embodiment of this invention. The arrangement of this third embodiment differs from that of FIG. 11 in that all the composite magnetic cores 68 belonging to the same column are sealed in a container 69. Since the third embodiment is the same as that of FIG. 11 in other respects, the parts of the third embodiment are denoted by the same numerals as those of FIG. 11, and description thereof is omitted. Description is also omitted with respect to FIG. 19, with the parts thereof designated by the same numerals as those of FIG. 18. Referring to FIG. 18, a metal plate 55*a* constituting the indicated lower portion of a metal container 69 defines a deep cavity in which the composite magnetic core 68 is mostly received, with the electromagnetically operated surface of said core 68 disposed to face an armature 52. As in the second embodiment, the second coil 60 may be wound about all the composite magnetic cores belonging to the same column in common. Since FIGS. 13, 14 and 15 of the second embodiment can be applied intact to the third embodiment, description of the operation and effect of the third embodiment is omitted.

Figure 20:
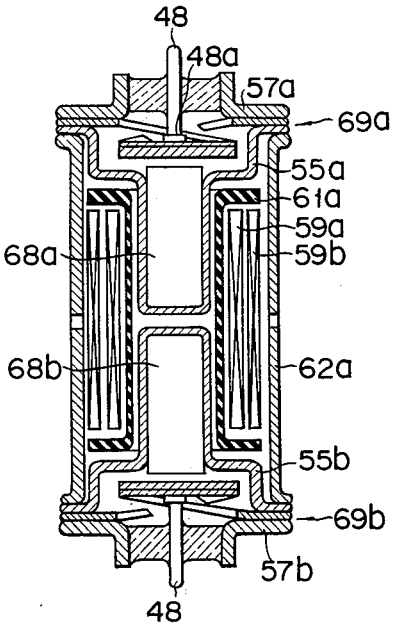
FIG. 20 is a sectional view of a modification of the column structure of FIG. 18.
Figure 24:
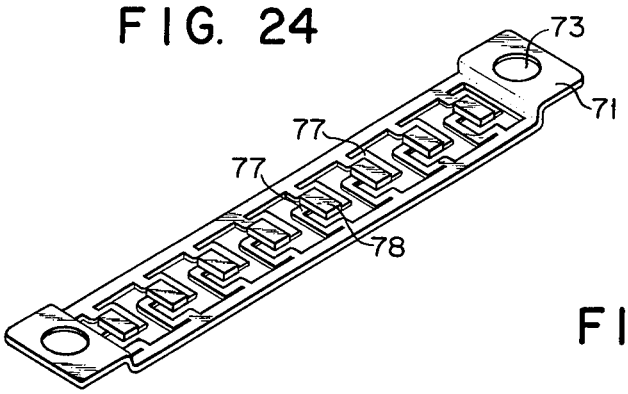
FIG. 24 is a magnified oblique view of a row conductor of FIG. 22.
Figure 25:
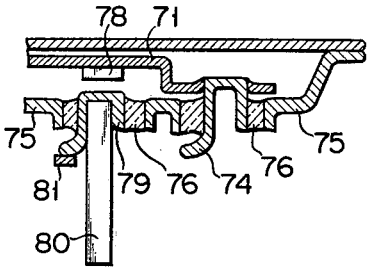
FIG. 25 is a magnified view of the section 72 of FIG. 23.

FIG. 20 shows an arrangement modified from the third embodiment by integrally assembling two adjacent column containers 69*a*, 69*b*. Since the arrangement of FIG. 20 is exactly the same as that of FIG. 16, excepting that the magnetic cores 68*a*, 68*b* are sealed in the containers 69*a*, 69*b* respectively, description of the arrangement of FIG. 20 is omitted. FIG. 21 sets forth another modification of the third embodiment, wherein each pair of the cross point switches belonging to two adjacent columns is integrally assembled. The arrangement of FIG. 21 is exactly the same as that of FIG. 17, excepting that the magnetic cores 68*a*, 68*b* are sealed in a container.

The third embodiment, wherein the magnetic cores 68*a*, 68*b* do not penetrate the containers 57*a*, 57*b* respectively, is not only saved from the drawbacks of the prior art electromagnetic coordinate selection device, but also renders such device compact and inexpensive and attains its reliable operation.

There will now be described by reference to FIGS. 22 to 26 a fourth embodiment of this invention, wherein all the cross point switches arranged in the matrix form are sealed in a single metallic container 70. FIG. 22 shows the arrangement of the parts sealed in said container 70, with part thereof removed. A row conductor (row signal line) 71 is shown in detail in the magnified oblique view of FIG. 24. Part of the cross section of the central portion of the row conductor (along line 23—23 of FIG. 22) is indicated in FIG. 23. That section of FIG. 23 which is enclosed in a broken line is shown in magnification in FIG. 25. There will now be described by reference to FIGS. 22 to 25 the arrangement of the fourth embodiment. A row conductor 71 is, for example, soldered to a row terminal member 74 by means of a hole 73 (FIG. 24) bored at both ends of said row conductor 71. The terminal member 74 penetrates a metal plate 75 constituting the underside of the container 70 through a glass sealing member 76. The row conductor 71 is made of an elastic metal strip in the form illustrated in FIG. 24. The row conductor 71 is punched to provide movable spring members 77. A movable contact member 78 is welded to the center of every two movable spring members 77. A stationary contact member 79 is formed like a cap, in the cavity of which the inner end of a composite magnetic core 80 is received. The stationary contact member 79 penetrates the bottom metal plate 75 by being insulated by the glass sealing member 76, with the effective surface of said stationary contact member 79 exposed to the inside of the container 70. Of course, the stationary contact member 79 is so disposed as to face the movable contact member 78. Stationary contact members 79 belonging to the same column are electrically connected in a body to a column signal conductor 81 (FIG. 25) outside of the container 70. The composite magnetic cores 80 belonging to the same column are wound with first coils 82 (connected in series in the column direction) by means of corresponding bobbins 83*a* (FIG. 23). The composite magnetic cores belonging to the same row are collectively wound with a second common coil 84 (row winding) by means of a bobbin 83*b* as shown in the nonexploded section of FIG. 23. Referential numeral 85 denotes a protective tape of said second common coil 84. The metal container 70 consists of an upper metal plate 86 and the bottom metal plate 75 bonded together on the periphery. Terminals of each coil are not illustrated.

Figure 26:
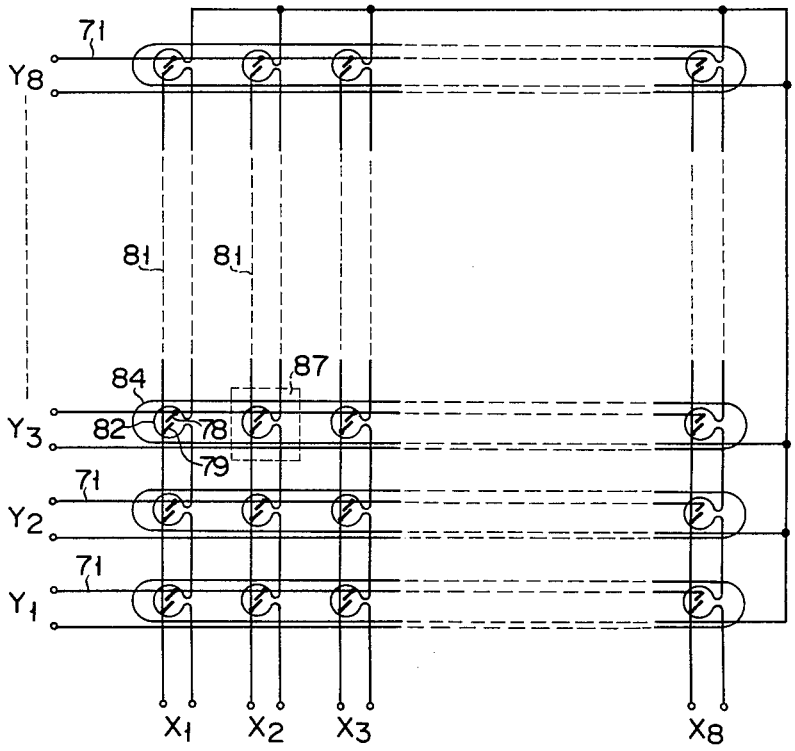
FIG. 26 is a plan view showing the arrangement of the structural components of FIG. 23 and the electrical connection thereof.

FIG. 26 is a plan view showing the arrangement and electrical connection of the row conductors 71, column conductors 81, movable contact members 78, stationary contact members 79, first coils 82 connected in series in the column direction, and second coils 84 each wound about the composite magnetic cores belonging to the same row in common. Referring to FIG. 26, one column conductor 81 and a corresponding series circuit consisting of first coils 82 are taken as a group. The respective groups are indicated by coordinate notations $X_1$ to $X_8$. Similarly, one row conductor 71 and the corresponding second common coil 84 are taken as a group. The respective groups are shown by coordinate notations $Y_1$ to $Y_8$. Though FIG. 26 sets forth an $8 \times 8$ matrix arrangement of cross point switches, yet these switches may generally by assembled in an $m \times n$ matrix formation.

The description of the magnetization characteristics of a composite magnetic core indicated in FIG. 3 is also applicable to the operation of the fourth embodiment. Namely, where, in FIG. 26, one of the first and second coils 82, 84 is impressed with pulses $U_3'$, $U_4'$ (represented by ampere turns) in succession, then all the cross point switches are latched in an open state. Where any selected first and second coils 82, 84 are supplied alike with said pulses $U_3'$, $U_4'$ in succession, then only a switch provided at the cross point of said selected coils is latched in a closed state. The reason for this event has already been given with respect to FIG. 3, description thereof being omitted. Where the coils denoted by the coordinate notations $X_2$, $Y_3$ are supplied alike with operation pulses, then only the cross point switch 87 is closed and switches at other cross oints remain open.

Figure 27:
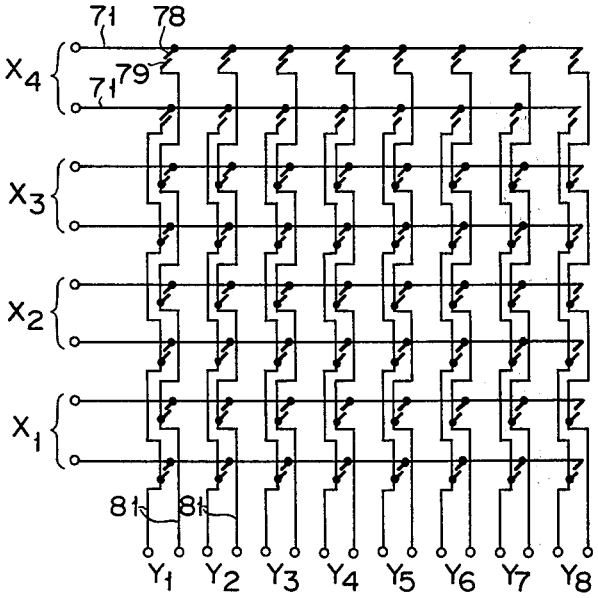
FIG. 27 is a plan view showing a modification of the arrangement of the structural components of the fourth embodiment as well as of the electrical connection thereof.

FIG. 27 shows the modified arrangement and electrical connection of the row conductor 71, column conductor 81, movable contact member 78 and stationary contact member 79 of the fourth embodiment. This modification attains the coordinate selection of a matrix circuit requiring to be concurrently used as forward and return speech paths. This electrical connection of FIG. 27 attains the abovementioned object simply by providing a larger number of column conductors 81 than in FIG. 26.

In the fourth embodiment of FIGS. 22 to 26, it is possible to wind the first coil about the composite magnetic cores belonging to the same column in common at the upper or lower part of cores, and wind the second coil about the composite magnetic cores belonging to the same row in common at the lower or upper part of said cores. The container 70 may be formed of insulating material. Further, a plurality of said containers may be provided for each row, or every several rows.

The fourth embodiment eliminates the necessity of insulating the composite magnetic core from a container, for example, by a glass sealing member, admitting of the free selection of a composite magnetic core without taking into account the critical magnetization temperature of said magnetic core. Further, the fourth embodiment makes it extremely easy to render an electromagnetic coordinate selection device compact and inexpensive.

What we claim is:

1. An electromagnetic coordinate selection device comprising a plurality of cross point switches each provided with a stationary contact member and movable contact member and arranged in a matrix form to carry out electrical connection and disconnetion between the row and column conductors, a plurality of magnetic cores disposed at points corresponding to the cross point switches to drive the movable contact members, a first coil wound about the respective magnetic cores to introduce selection current of at least one of a row and column, and a second coil wound about said magnetic cores to transmit selection current of at least one of a column and row, respectively, wherein the magnetic core is of the composite type comprising a first magnetic core member generating a sufficient amount of coercive force to latch the movable contact members and a second magnetic core member providing a larger amount of coercive force than the first magnetic core member; and the cross point switches are all sealed in at least one container, the number of containers being not greater than the number of row or column conductors.

2. An electromagnetic coordinate selection device according to claim 1, wherein the composite magnetic cores are disposed fully outside of the containers.

3. An electromagnetic coordinate selection device according to claim 1, wherein the composite magnetic cores are sealed in the containers.

4. An electromagnetic coordinate selection device according to claim 1, wherein the first coils are wound about the respective composite magnetic cores, and the second coils are wound about the composite magnetic cores belonging to the same row in common.

5. An electromagnetic coordinate selection device according to claim 1, wherein the first coil is wound about the composite magnetic cores belonging to the same row in common and the second coil is wound about the composite magnetic cores belonging to the same column in common.

6. An electromagnetic coordinate selection device according to claim 1, wherein the cross point switches are sealed in a single container; the composite magnetic cores penetrate one wall of the container in airtightness and in a state electrically insulated from said wall; the stationary contact members are formed on those parts of said composite magnetic cores which are sealed in the container; those parts of the composite magnetic cores which extend outside of the container are connected to the corresponding row conductors;

the first and sescond coils are wound about those parts of the composite magnetic cores which extend outside of the container; the movable contact members are so positioned in the container as to face the corresponding stationary contact members formed on the composite magnetic cores; and the movable contact members belonging to the same column are electrically connected together within the container to be electrically drawn out of the container.

7. An electromagnetic coordinate selection device according to claim 1, wherein a plurality of cross point switches belonging to one column and those belonging to an adjacent column are sealed together in a unit container; the composite magnetic cores penetrate one wall of the unit container in a state electrically insulated therefrom; those parts of the composite magnetic cores which are sealed in the unit container are fitted with the stationary contact members and each of said composite magnetic cores which extends outside of the unit container is connected to a corresponding row conductor respectively; the first and second coils are wound about those parts in common of every two magnetic cores extending in the row direction which are disposed outside of the unit container; the movable contact members are so positioned in the unit container as to face the corresponding stationary contact members formed on the composite magnetic cores; and the movable contact members belonging to the same column which are sealed in the unit container are electrically connected together within the unit container to be electrically drawn out of the unit container.

8. An electromagnetic coordinate selection device according to claim 2, wherein the cross point switches are sealed in groups in a plurality of unit containers provided in the same number as the number of column conductors; each unit container holds the same number of cross point switches as the number of row conductors; the stationary contact members of the cross point switches are formed on the inner ends of the signal terminals penetrating one wall of the respective unit containers in a state electrically insulated from said wall; the movable contact-member-driving surface of the composite magnetic core faces the stationary contact members through the opposite wall of the unit container; the movable contact members are formed on the armatures sealed in the unit container between the movable contact-member-driving surface of the composite magnetic core and the corresponding stationary contact members; each armature is supported by a spring member to be provided with a righting moment; the spring members are so supported in the unit container as to cause the armatures to be electrically connected together in the column direction; and each of the signal terminals is connected to a corresponding row conductor respectively outside of the unit container.

9. An electromagnetic coordinate selection device according to claim 8, wherein every two adjacent unit containers are coupled together by a yoke such that the cross point switches included in two adjacent columns and paired with each other in the row direction are disposed in opposite directions; the two adjacent composite magnetic cores for operating said cross point switches paired in the row direction are so positioned in the yoke as to have the nondriving surfaces of said composite magnetic cores set opposite to each other; and the first and second coils are wound about said two adjacent composite magnetic cores in common.

10. An electromagnetic coordinate selection device according to claim 8, wherein every two adjacent unit containers are coupled together by a yoke such that the cross point switches included in two adjacent columns and paired with each other in the row direction are set in opposite directions, with the vertical central lines of said two adjacent unit containers disposed crosswise apart; the two adjacent composite magnetic cores for operating said cross point switches paired in the row direction are so positioned in the yoke as to have the side walls of said composite magnetic cores set opposite to each other; and the first and second coils are wound about said two adjacent composite magnetic cores in common.

11. An electromagnetic coordinate selection device according to claim 3, wherein the cross point switches are sealed in groups in a plurality of unit containers provided in the same number as the number of column conductors; each unit containers holds the same number of cross point switches as the number of row conductors; the stationary contact members of the cross point switches are formed on the inner ends of the signal terminals penetrating one wall of the respective unit containers in a state electrically insulated from said wall; the movable contact-member-driving surface of each composite magnetic core sealed in the same unit container faces the corresponding stationary contact members and the nondriving surface of said composite magnetic core is pressed against the inside of the opposite wall of the unit container; the movable contact members are formed on the armatures sealed in the unit container between the movable contact-member-driving surface of the composite magnetic cores and the corresponding stationary contact members; each armature is supported by spring members to be provided with a righting moment; the spring members are so supported in the unit container as to cause the armatures to be electrically connected together in the column direction; and each of the signal terminals is connected to a corresponding row conductor respectively outside of the unit container.

12. An electromagnetic coordinate selection device according to claim 11, wherein every two adjacent unit containers are coupled together by a yoke such that the cross point switches included in two adjacent columns and paired with each other in the row direction are disposed in opposite directions; the two adjacent composite magnetic cores for operating said cross point switches paired in the row direction are so positioned in the yoke as to have the nondriving surfaces of said composite magnetic cores set opposite to each other; and the first and second coils are wound about said two adjacent composite magnetic cores in common.

13. An electromagnetic coordinate selection device according to claim 11, wherein every two adjacent containers are coupled together by a yoke such that the cross point switches included in two adjacent columns and paired with each other in the row direction are set in opposite directions, with the vertical central lines of said two adjacent unit containers disposed crosswise apart; the two adjacent composite magnetic cores for operating said cross point switches paired in the row direction are so positioned in the yoke as to have the side walls of said composite magnetic cores set opposite to each other; and the first and second coils are wound about said two adjacent composite magnetic cores in common.

14. An electromagnetic coordinate selection device according to claim 2, wherein the cross point switches are all sealed in a single container; a plurality of stationary contact substrates having stationary contact members formed thereon are arranged in a matrix form on one wall of the container in a state insulated from said one wall by insulating material such that said stationary contact members protrude into the container; the movable contact members are supported by elastic members so as to face the stationary contact members; the elastic members supporting within the container the movable contact members belonging to the same row are electrically connected together in the row direction to be electrically drawn out of the container; the composite magnetic cores are so positioned as to have the movable contact-member-driving surfaces of said compcsite magnetic cores pressed against the outer surfaces of the corresponding stationary contact substrates; and the composite magnetic cores belonging to the same column are jointly connected to the corresponding column conductor outside of the container.

15. An electromagnetic coordinate selection device according to claim 14, whrerin the first coil is wound about the individual composite magnetic cores, and the second coil is wound about the composite magnetic cores belonging to the same row in common.

16. An electromagnetic coordinate selection device according to claim 14, wherein the first coil is wound about the composite magnetic cores belonging to the same column in common, and the second coil is wound about the composite magnetic cores belonging to the same row in common.

17. An electromagnetic coordinate selection device according to claim 1, wherein the first coil is wound about the composite magnetic cores belonging to the same column in common and the second coil is wound about the composite magnetic cores belonging to the same row in common.

18. An electromagnetic coordinate selection device according to claim 1, wherein said first coil is wound about the respective magnetic cores to introduce selection current of a row, and said second coil is wound about said magnetic cores to transmit selection current of a column.

19. An electromagnetic coordinate selection device according to claim 1, wherein said first coil is wound about the respective magnetic cores to introduce selection current of a column, and said second coil is wound about said magnetic cores to transmit selection current of a row.

20. An electromagnetic coordinate selection device according to claim 1, wherein said cross point switches are sealed in groups in a plurality of said containers, each group being contained in a respective container.

* * * * *